US009427671B2

(12) United States Patent
O'Connor et al.

(10) Patent No.: US 9,427,671 B2
(45) Date of Patent: Aug. 30, 2016

(54) TOY VEHICLE LAUNCHER AND TOY TRACK FOR USE THEREWITH

(71) Applicant: MATTEL, INC., El Segundo, CA (US)

(72) Inventors: Stacy L. O'Connor, Long Beach, CA (US); Gustavo Ferreyra, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/725,918

(22) Filed: May 29, 2015

(65) Prior Publication Data

US 2015/0343319 A1 Dec. 3, 2015

Related U.S. Application Data

(60) Provisional application No. 62/005,332, filed on May 30, 2014.

(51) Int. Cl.
*A63H 29/00* (2006.01)
*A63H 17/00* (2006.01)

(52) U.S. Cl.
CPC ..... *A63H 17/008* (2013.01)

(58) Field of Classification Search
USPC ..... 446/6, 429, 430, 431, 433, 435, 444, 446/445, 446, 457, 459, 465
See application file for complete search history.

(56) References Cited

U.S. PATENT DOCUMENTS

| | | | | | |
|---|---|---|---|---|---|
| 214,154 | A | | 4/1879 | Johnson | |
| 755,446 | A | | 3/1904 | Butcher | |
| 2,517,084 | A | | 8/1950 | Carver | |
| 2,531,056 | A | * | 11/1950 | Koesten | A63H 33/36 431/125 |
| 2,788,613 | A | | 4/1957 | Gelfand | |
| 2,803,922 | A | | 8/1957 | Holt | |
| 3,216,529 | A | | 11/1965 | Lohr | |
| 3,471,963 | A | | 10/1969 | Tomiyama | |
| 3,696,555 | A | | 10/1972 | Bales | |
| 3,701,216 | A | | 10/1972 | Smith, III | |
| 3,757,459 | A | | 9/1973 | Buck | |
| 3,777,391 | A | * | 12/1973 | Barcus | A63H 17/008 446/430 |
| 3,798,832 | A | | 3/1974 | Terzian | |
| 3,877,169 | A | | 4/1975 | Munday | |
| 3,886,682 | A | | 6/1975 | Ieda | |
| 3,919,804 | A | | 11/1975 | Nakata | |
| 3,932,957 | A | | 1/1976 | Morrison | |
| 3,959,920 | A | | 6/1976 | Ieda | |
| 4,016,674 | A | | 4/1977 | Resnick | |
| 4,108,437 | A | * | 8/1978 | DeAnda | A63H 17/008 446/429 |
| 4,146,991 | A | * | 4/1979 | Sano | A63H 18/028 446/430 |

(Continued)

*Primary Examiner* — Kurt Fernstrom
(74) *Attorney, Agent, or Firm* — Edell, Shapiro & Finnan, LLC

(57) ABSTRACT

Disclosed is a launcher for a toy vehicle having a biased carriage that holds a toy vehicle as a drive wheel on the toy vehicle is being energized, and that propels the energized toy vehicle forward and onto a toy racetrack when the biased carriage is released. A launcher housing includes a carriage capture and release assembly that remains in an armed, ready position until a toy vehicle is positioned on the carriage, a pull cord is inserted through the launcher housing and into engagement with the drive wheel on the toy vehicle, and the pull cord is thereafter withdrawn from the toy vehicle and the housing. After the pull cord is fully withdrawn, the carriage capture and release assembly releases the carriage, allowing a biasing member to propel the carriage forward so as to launch the energized toy vehicle. The launcher may be combined with a toy racetrack having various stunt features through which a toy vehicle may travel after its launch.

20 Claims, 10 Drawing Sheets

(56) References Cited

U.S. PATENT DOCUMENTS 4,345,402 A 8/1982 Hanson
4,403,440 A 9/1983 Wulff
4,406,084 A 9/1983 D'Andrade
4,413,443 A 11/1983 Kulesza
4,418,495 A 12/1983 Kennedy
4,425,735 A * 1/1984 Kulesza ..... A63H 18/028 446/28
4,479,326 A 10/1984 Kennedy
4,483,096 A 11/1984 Gabler
4,498,886 A 2/1985 Goldfarb
4,526,554 A 7/1985 Goldfarb
4,732,569 A * 3/1988 Hippely ..... A63H 17/008 446/430
D302,191 S 7/1989 Lakin
4,946,417 A * 8/1990 Ishikawa ..... A63H 17/22 446/430
4,959,035 A 9/1990 Murasaki
5,141,468 A 8/1992 Suzuki
5,433,641 A * 7/1995 Rudell ..... A63H 17/008 124/79
5,460,560 A 10/1995 Liu
5,522,752 A 6/1996 Liu
5,643,036 A 7/1997 Liu
5,643,040 A * 7/1997 Hippely ..... A63H 18/026 446/423
5,674,105 A 10/1997 Hamlin
5,823,848 A * 10/1998 Cummings ..... A63H 29/20 446/429
6,000,992 A * 12/1999 Lambert ..... A63H 18/026 446/430
6,435,929 B1 * 8/2002 Halford ..... A63H 17/02 273/108.53
6,666,743 B2 12/2003 Polare
6,676,476 B1 1/2004 Lund
6,743,070 B1 6/2004 Lin
6,905,389 B2 6/2005 Matsukawa
7,033,304 B2 4/2006 Chuang
D550,781 S 9/2007 Laurienzo
D554,201 S 10/2007 Vetuskey
D574,442 S 8/2008 Higuchi
7,427,225 B2 9/2008 Matsukawa
7,500,898 B2 3/2009 Laurienzo
7,568,578 B2 8/2009 Berman
7,594,843 B2 9/2009 Vetuskey
D637,661 S 5/2011 Horikoshi
7,950,976 B2 5/2011 Bernstein
8,083,566 B2 12/2011 Finlan
8,388,405 B2 * 3/2013 Desent ..... A63H 17/008 446/429
8,568,191 B2 * 10/2013 Rehkemper ..... A63H 33/003 273/108
2006/0099879 A1 5/2006 McGrath
2006/0099880 A1 5/2006 Laurienzo
2006/0121820 A1 6/2006 Laurienzo
2006/0211331 A1 9/2006 Trageser
2008/0070472 A1 3/2008 Campbell
2008/0194173 A1 8/2008 Tiefel
2010/0093256 A1 4/2010 Carlson
2011/0086574 A1 * 4/2011 Nuttall ..... A63H 18/028 446/429
2011/0177750 A1 7/2011 Ujita
2011/0294395 A1 * 12/2011 O'Connor ..... A63H 18/023 446/429
2013/0102223 A1 4/2013 Brooks

* cited by examiner

TOY VEHICLE LAUNCHER AND TOY TRACK FOR USE THEREWITH

CROSS-REFERENCE TO RELATED APPLICATIONS

This application is based upon and claims priority from U.S. Provisional Patent Application Ser. No. 62/005,332 entitled "Toy Vehicle Launcher and Toy Track for Use Therewith," filed with the United States Patent and Trademark Office on May 30, 2014, the entire disclosure of which is incorporated herein by reference in its entirety.

FIELD OF THE INVENTION

The present invention relates to toy vehicle launchers for use with toy tracks.

BACKGROUND

Toy racetracks are popular among children of varied ages. Children enjoy a variety of track features and track configurations, and continually seek new toy racetrack features to enhance the play experience. While various devices have previously been provided to launch toy vehicles onto a racetrack, there remains opportunity to further enhance the play experience by providing new and unique toy vehicle launching systems for use with toy racetracks.

It would therefore be advantageous to provide a toy vehicle launcher and a toy racetrack for use with such launcher that further enhances the excitement and amusement offered to a child as they engage in such play.

SUMMARY OF THE INVENTION

Disclosed is a launcher for a toy vehicle. The launcher has a biased carriage that holds a toy vehicle as a drive wheel on the toy vehicle is being energized, and that propels the energized toy vehicle forward and onto a toy track when the biased carriage is released. A launcher housing includes a carriage capture and release assembly that remains in an armed, ready position until a toy vehicle is positioned on the carriage, a pull cord is inserted through the launcher housing and into engagement with the drive wheel on the toy vehicle, and the pull cord is thereafter withdrawn from the toy vehicle and the housing. After the pull cord is fully withdrawn, the carriage capture and release assembly releases the carriage, allowing a biasing member to propel the carriage forward so as to launch the energized toy vehicle. The capture and release assembly can be referred to alternatively as a release assembly.

The launcher may be attached to and form a part of a toy track that may include one or more stunt features through which the toy vehicle may travel after launching from the launcher.

In accordance with certain aspects of an embodiment of the invention, a toy vehicle launcher is provided comprising a housing including a release assembly, a ramp section coupled to the housing, the ramp section defining a slot therein, a slidable carriage that is movable along the slot between a loaded position and a launched position, the slidable carriage being retained in its loaded position and biased toward its launched position by a biasing member, the slidable carriage being engageable with the release assembly, and a pull cord engageable with the housing, the pull cord being engageable with the release assembly and a toy vehicle coupled to the slidable carriage, the slidable carriage being released from its loaded position when the pull cord is retracted from the release assembly and traveling along the slot in the ramp section.

In accordance with further aspects of an embodiment of the invention, a toy vehicle and launcher assembly, comprising a toy vehicle having a wheel and an axle coupled to the wheel, the axle having a set of teeth, and a launcher, comprising a housing, a ramp section coupled to the housing, a carriage coupled to the ramp section and movable relative to the housing, the toy vehicle being engageable with the carriage, the carriage being positionable in a launching position and in a loaded position, and a pull cord engageable with the housing, the carriage, and the toy vehicle, wherein removal of the pull cord from the housing, the carriage, and the toy vehicle results in the carriage moving along the ramp section and the toy vehicle disengaging from the carriage.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of one or more particular embodiments of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
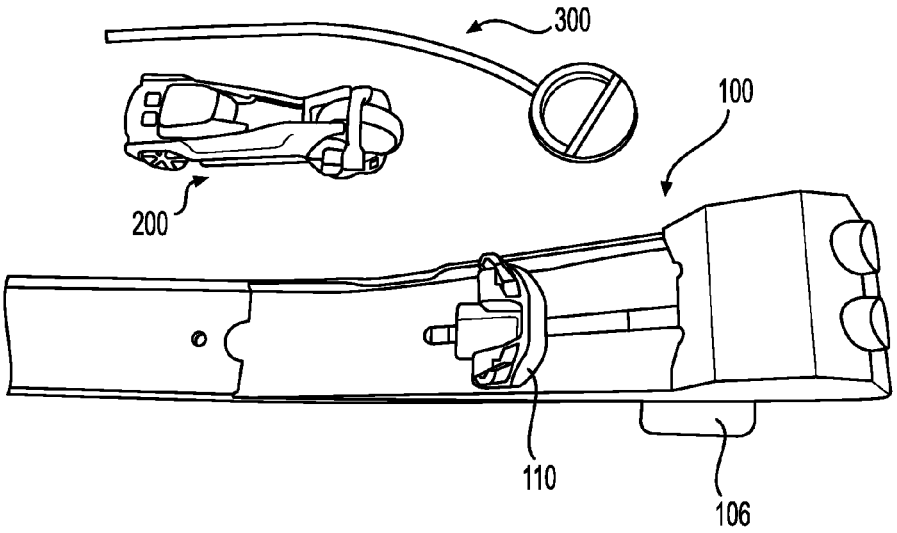
FIG. 1 is a top view of a launcher in accordance with certain aspects of an embodiment of the invention.

As shown in FIG. 1, and with regard to certain aspects of an embodiment of the invention, a launcher 100 for a toy vehicle 200 is provided. As explained in greater detail below, the launcher 100 includes a slidable, biased carriage 110 that pushes toy vehicle 200 forward and away from launcher 100 when carriage 110 is released from a loaded position. A pull cord 300 is configured to engage a drive wheel on toy vehicle 200, and to likewise engage a carriage capture and release assembly inside of launcher 100 that releases carriage 110 when the pull cord 300 is fully withdrawn from launcher 100. The launcher 100 includes downwardly extending legs 106 that can engage a support surface.

Figure 2:
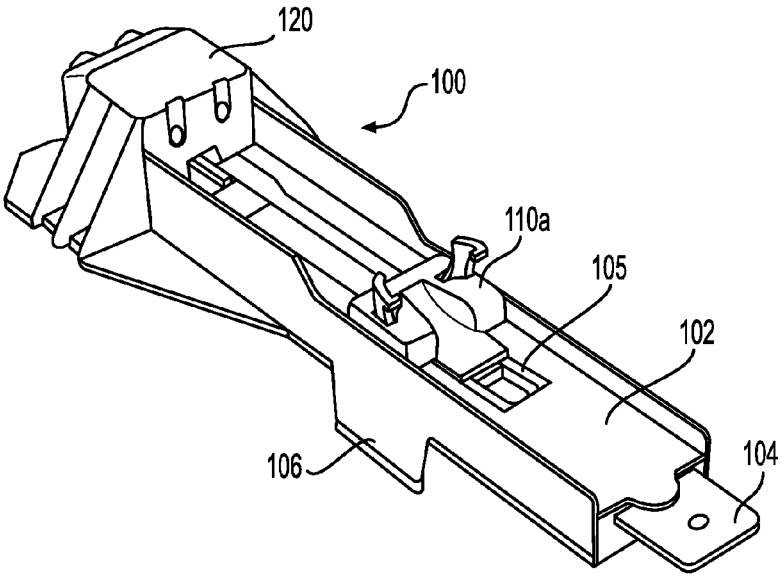
FIG. 2 is a front perspective view of a launcher in accordance with certain aspects of an embodiment of the invention.
Figure 3:
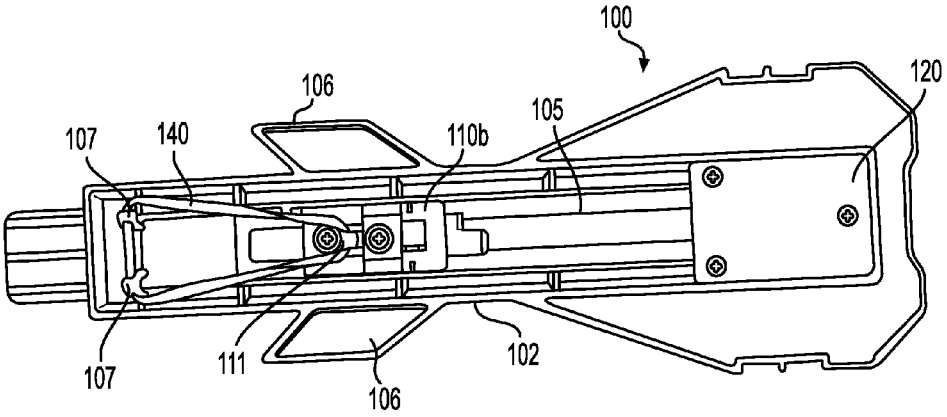
FIG. 3 is a bottom view of the launcher of FIG. 2.

As shown in the top perspective view of FIG. 2 and the bottom view of FIG. 3, launcher 100 includes ramp section 102, housing block 120 at the raised end of ramp section 102, and a tab 104 at the lower, forward end of ramp section 102, which tab 104 is configured for attachment to a section of extruded plastic toy track as is well known to those skilled in the art. Ramp section 102 has a longitudinal slot 105 extending along at least a portion of ramp section 102. Carriage 110 includes an upper portion 110*a*(see FIG. 2) and a lower portion 110*b*(see FIG. 3), which are configured such that the bottom of upper portion 110*a* and the top of lower portion 110*b* overlap the side edges defining the longitudinal slot 105 so as to allow carriage 110 to slide along slot 105 while preventing it from being inadvertently detached from slot 105. Slot 105 preferably extends from a starting point immediately adjacent housing block 120 toward the front, lower end of launcher 100, stopping at a distance from the front, lower end of launcher 100.

As shown in FIG. 3, the lower portion 110*b* of carriage 110 is biased by an elastic member 140, such as by way of non-limiting example a rubber band, toward the front, lower end of launcher 100. One or more clips 107 may be provided on the underside of launcher 100 positioned adjacent to the front, lower end of launcher 100 for receiving a first end of elastic member 140. Likewise, an elastic member receiver 111 may be provided on the lower portion 110*b* of carriage 110 for receiving the opposite end of elastic member 140. As slot 105 terminates a distance away from the front, lower end of launcher 100, elastic member 140 maintains a pull on carriage 110 throughout the entirety of its travel from its armed, ready position (shown in FIG. 18) to the launched position (shown in FIG. 1). As referenced above, downwardly extending legs 106 may be provided on the sides of ramp section 102 so as to elevate the rear portion of launcher 100.

Figure 4:
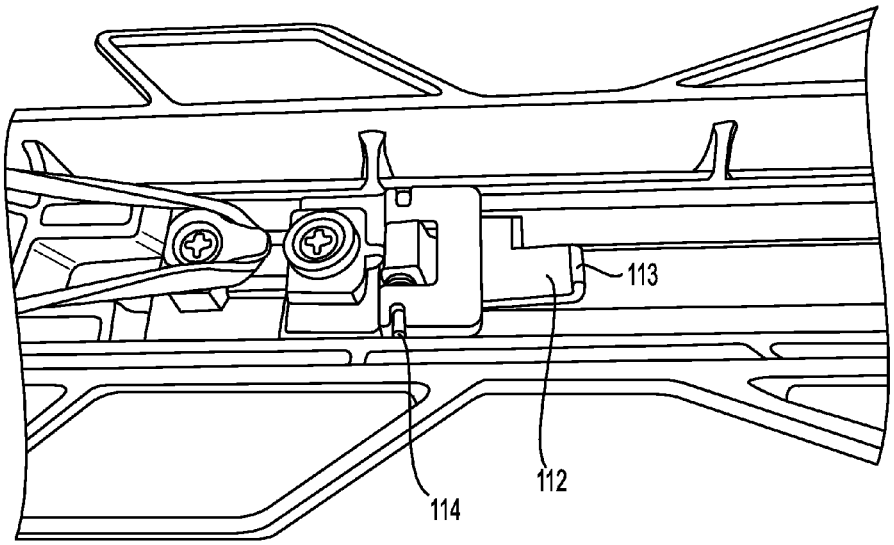
FIG. 4 is a close-up, bottom view of a portion of the launcher of FIG. 2.

In order to hold carriage 110 in place in the ready position (shown in FIG. 18) until such time as a user launches a toy vehicle, housing block 120 includes a carriage capture and release assembly 124 (see FIG. 5) that releases carriage 110 when the pull cord 300 is fully withdrawn from launcher 100. As shown in the close-up bottom view of FIG. 4, carriage 110 has a rearwardly extending carriage hook arm 112 having a downward facing hook 113 at the rear edge thereof. Carriage hook arm 112 is pivotably attached to carriage 110 at a pivot connection 114, and a biasing member, such as a spring, biases the carriage hook arm 112 downward with respect to the rest of carriage 110. When carriage 110 is in place in the ready position, hook 113 engages a retaining ledge 121 on a bottom cover 122 of housing block 120 (bottom cover 122 being shown removed from the base of housing block 120 in FIG. 5). An inclined ramp surface 123 may be provided on the front side of retaining ledge 121 to help to push hook 113 upward as it approaches retaining ledge 121. Once in this ready position (in which hook 113 engages a rear surface of retaining ledge 121), carriage 110 is held in this ready position until hook 113 is lifted so as to clear the top edge of retaining ledge 121, at which time elastic member 140 will quickly pull carriage 110 forward to launch a toy vehicle positioned on carriage 110.

Hook 113 is lifted over retaining ledge 121 by the carriage capture and release assembly (shown generally at 124) positioned within housing block 120. Carriage capture and release assembly 124 includes a carrier block 125, which carrier block 125 is vertically movable within an internal housing 126 mounted within housing block 120. As shown in the bottom view of internal housing 126 of FIG. 6, carrier block 125 is upwardly spring biased by a spring member 127 positioned between a spring post head 128 and the underside of carrier block 125. When pull cord 300 is inserted into housing block 120, it passes through openings (not shown) in carrier block 125 and pushes carrier block 125 downward against the bias of spring member 127. Likewise, full removal of pull cord 300 from carrier block 125 allows the bias of spring member 127 to return carrier block 125 to its raised position.

Carrier block 125 carries a carriage actuator 129 that is pivotably mounted to carrier block 125, allowing carriage actuator 129 to pivot about a horizontal axis with respect to carrier block 125 so as to rock back and forth toward and away from the front side 130 of internal housing 126. Front side 130 of internal housing 126 has a window 131 through which the front portion of carriage actuator 129 extends. The front portion of carriage actuator 129 is provided a tongue 132 that is engaged by carriage 110 to rock carriage actuator 129 rearward (away from the position shown in FIG. 6), as will be discussed in further detail below. Carriage actuator 129 also includes a lift arm 133 that is configured to engage a lift surface 115 on carriage hook arm 112.

Figure 5:
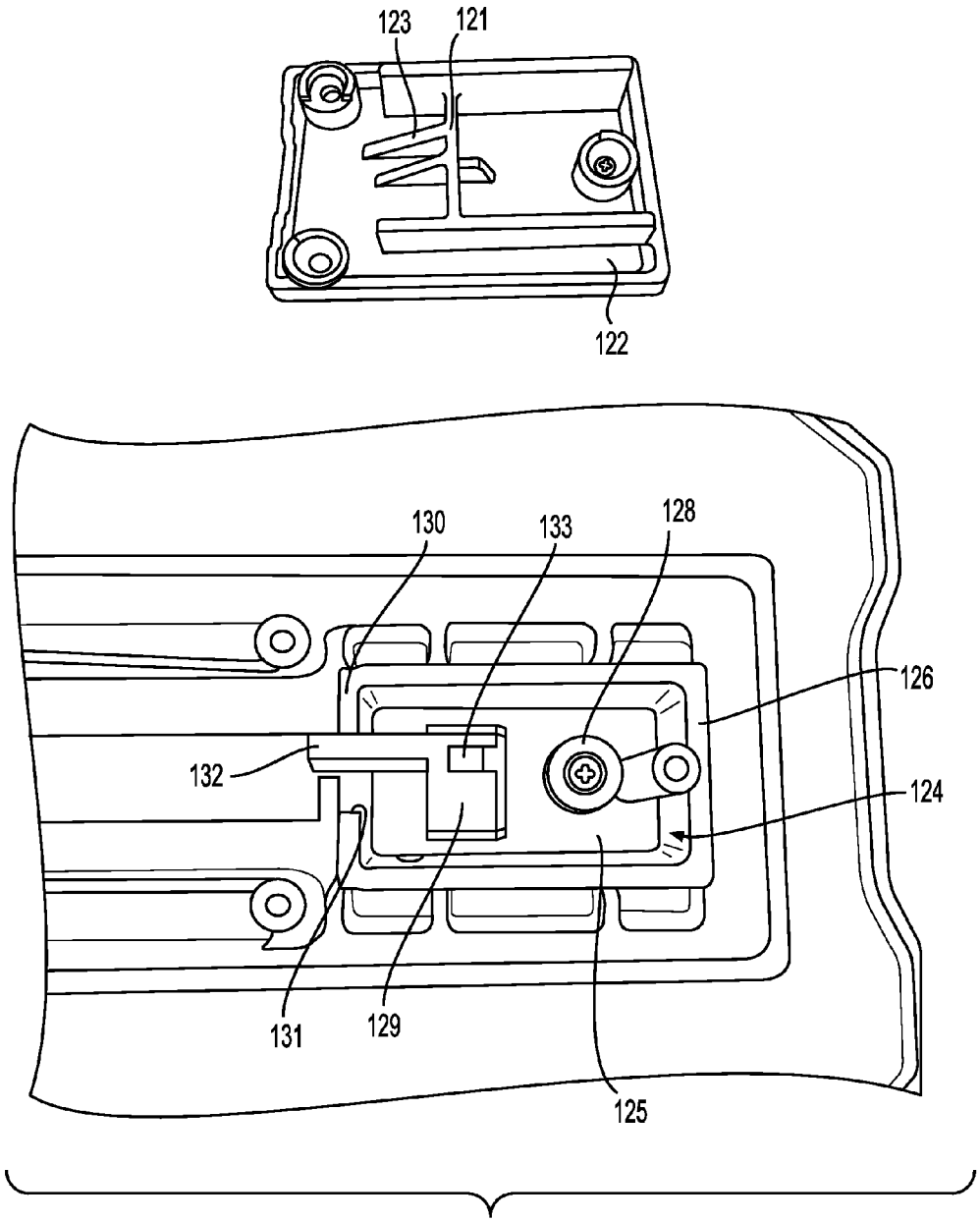
FIG. 5 is a close-up, bottom view of a portion of the launcher of FIG. 2 in a partially disassembled state.
Figure 6:
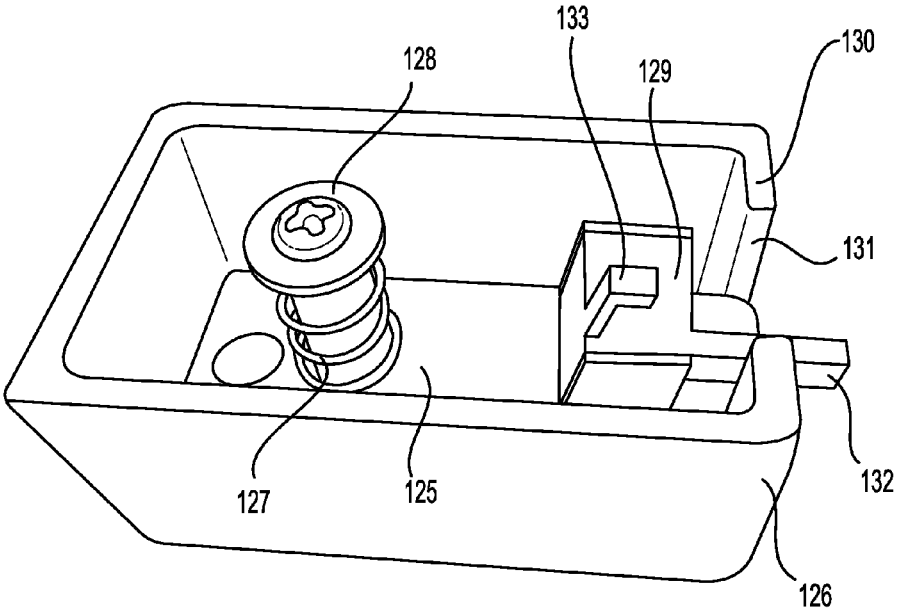
FIG. 6 is a close-up, bottom view of a carriage capture and release assembly for use with the launcher of FIGS. 1 and 2.
Figure 7:
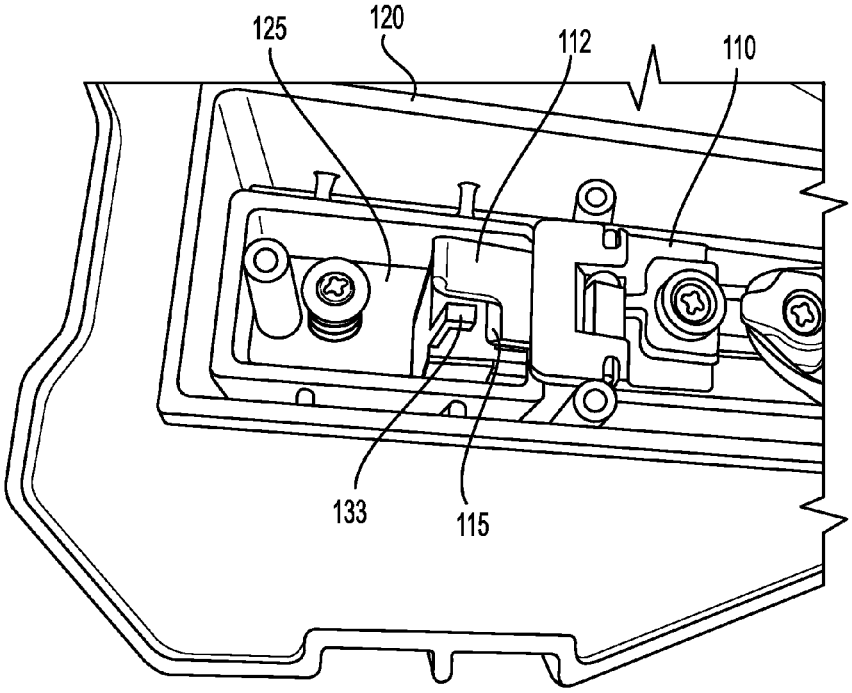
FIG. 7 is a close-up, bottom view of the carriage capture and release assembly of FIG. 6 in a disengaged position.
Figure 8:
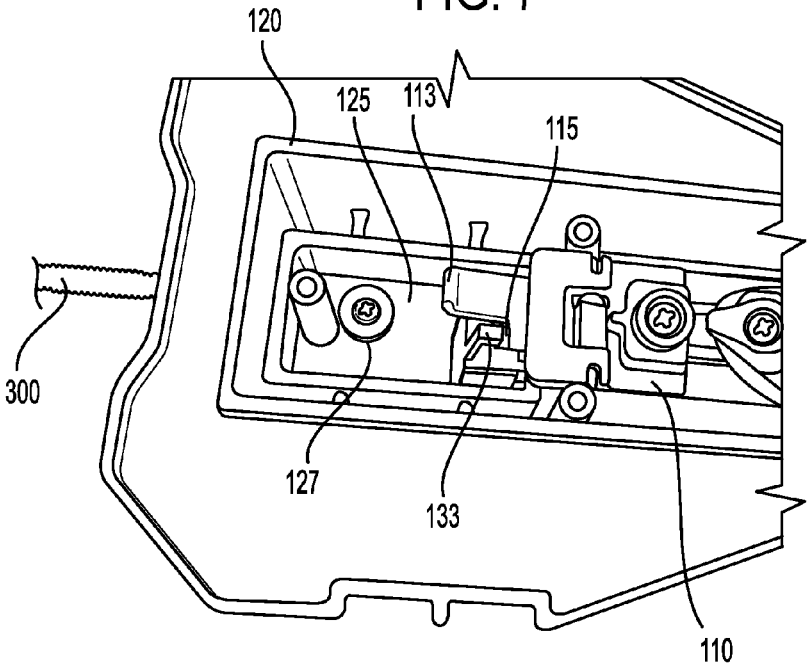
FIG. 8 is a close-up, bottom view of the carriage capture and release assembly of FIG. 6 in an engaged position.

More particularly, with reference to FIG. 7, when carriage 110 is positioned at its rearmost, ready position, and without pull cord 300 inserted in housing block 120, carrier block 125 is in a raised position such that lift arm 133 does not drop below the lift surface 115 on carriage hook arm 112. However, and with reference to FIG. 8, when pull cord 300 is inserted into housing block 120, carrier block 125 moves downward against the bias of spring member 127 (see FIG. 6), in turn lowering lift arm 133 below lift surface 115 on carriage hook arm 112. If, as explained in greater detail below, carriage 110 engages tongue 132 (which is shown in FIGS. 5 and 6) on the front of carriage actuator 129 (which occurs when a toy vehicle is not loaded in carriage 110), carriage actuator 129 is pivoted, against the bias of a spring, toward the rear of housing block 120, such that lift arm 133, while at a lower position than lift surface 115 on carriage hook arm 112, will not engage lift surface 115. However, if carriage 110 does not engage tongue 132 (which occurs when a toy vehicle is loaded in carriage 110), carriage actuator 129 is spring-biased to its forward most position, in which position lift arm 133 extends beneath lift surface 115 on carriage hook arm 112. In this engaged position, when pull cord 300 is fully removed from housing block 120, carrier block 125 will be raised by spring member 127, lifting carriage actuator 129 (and thus lift arm 133), in turn lifting carriage hook arm 112 so as to cause downward facing hook 113 to lift above the top edge of retaining ledge 121. Once downward facing hook 113 is lifted above the top edge of retaining ledge 121, elastic member 140 will quickly pull carriage 110 forward to launch the toy vehicle.

Because carriage 110 is configured to only engage tongue 132 when a toy vehicle is not loaded in carriage 110, insertion and removal of pull cord 300 into housing block 120 when a toy vehicle is not loaded will not release carriage 110 from its ready position. Rather, only when a toy vehicle is loaded (which in turn will cause carriage 110 to disengage from tongue 132 on carriage capture and release assembly 124, allowing carriage actuator 129 to pivot into engagement with carriage hook arm 112) will the release mechanism of carriage capture and release assembly 124 be engaged, thus causing the carriage to be released once the pull cord 300 is withdrawn.

Figure 9:
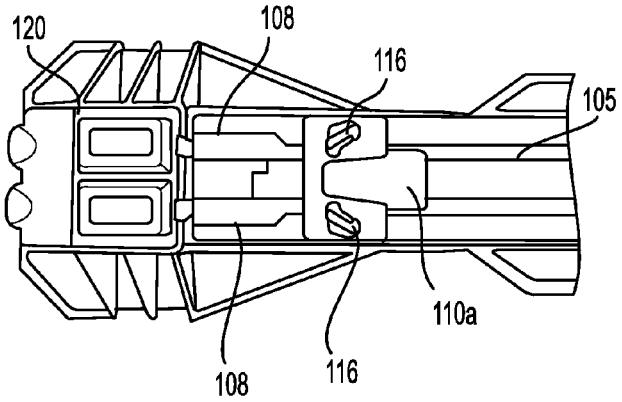
FIG. 9 is a top view of the launcher of FIG. 2 showing the carriage in a first position without a toy vehicle.
Figure 10:
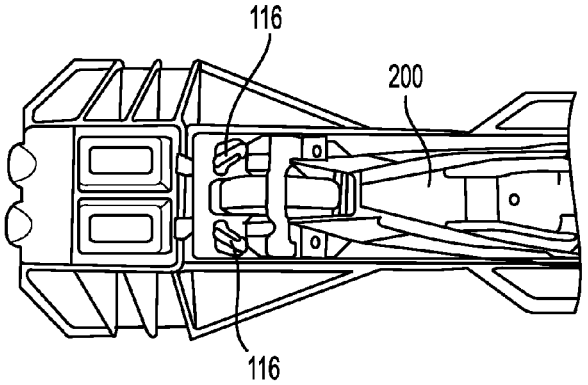
FIG. 10 is a top view of the launcher of FIG. 2 showing the carriage in an armed, ready position without a toy vehicle positioned for launch.
Figure 11:
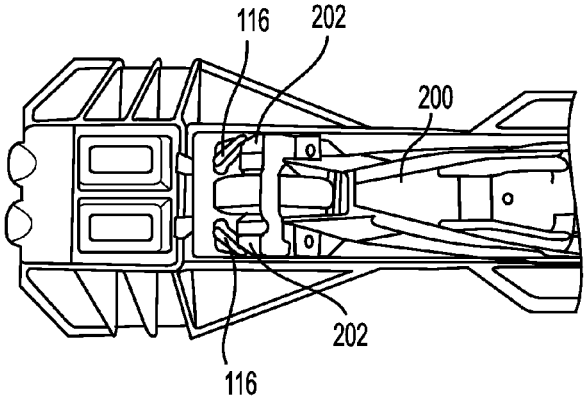
FIG. 11 is a top view of the launcher of FIG. 2 showing the carriage in an armed, ready position with a toy vehicle positioned for launch.

The mechanism for selectively causing carriage 110 to engage carriage capture and release assembly 124 only when a toy vehicle is positioned on carriage 110 is embodied in moveable arms 116 (FIGS. 9-11) that extend upward from carriage upper portion 110*a*, and which are pivotably mounted to carriage 110. Carriage 110 interacts with ramp section 102 so as to cause the top portions of moveable arms 116 to move toward one another as the carriage 110 is moved toward housing block 120. More particularly, the upper face of ramp section 102 is provided with cam surfaces 108 on opposite sides of longitudinal slot 105. Each cam surface 108 engages a bottom portion of one of the moveable arms 116. Moreover, the bottom portions of moveable arms 116 are spring biased toward one another. Thus, as carriage 110 is moved toward housing block 120, the upper portions of moveable arms 116 will move from the outer position shown in FIG. 9 (where the bottom portions of moveable arms 116 engage the narrow-most portion of cam surfaces 108) to the inward position shown in FIG. 10 (where the bottom portions of moveable arms 116 engage the wider portion of cam surfaces 108). In the position shown in FIG. 10, in which toy vehicle 200 is not yet seated within carriage 110, the bottom portion of moveable arms 116 are positioned so that at least one of moveable arms 116 aligns with and engages tongue 132, thus pivoting carriage actuator 129 rearward so that lift arm 133 on carriage actuator 129 does not engage lift surface 115 on carriage hook arm 112. Likewise, and as shown in FIG. 11, when toy vehicle 200 is fully seated in carriage 110, engagement clips 202 on toy vehicle 200 engage arms 116 to push the top portions of arms 116 slightly outward, in turn causing the bottom portions of arms 116 to pivot slightly inward, causing misalignment between arms 116 and tongue 132 on carriage actuator 129. When arms 116 no longer engage tongue 132, carriage actuator 129 pivots forward, thus causing lift arm 133 to engage lift surface 115 on carriage hook arm 112.

In this position, as pull cord 300 is inserted into housing block 120, carrier block 125 is pushed downward, causing lift arm 133 to push below lift surface 115 (carriage actuator 129 pivoting slightly rearward against its spring bias as lift arm 133 passes over lift surface 115 of carriage hook arm 112). Thereafter, as pull cord 300 is pulled fully out of housing block 120, carrier block 125 rises under the force of spring member 127, raising lift arm 133 and in turn carriage hook arm 112 so as to disengage downward facing hook 113 from retaining ledge 121 and allowing elastic member 140 to quickly pull carriage 110 forward to launch the toy vehicle.

As pull cord 300 is pulled outward from housing block 120, ribs 302 rotate axle 206 of toy vehicle 200, in turn rotating drive wheel 204 so as to help propel toy vehicle 200 through a toy racetrack (described further below) after it has been launched from launcher 100.

Figure 12:
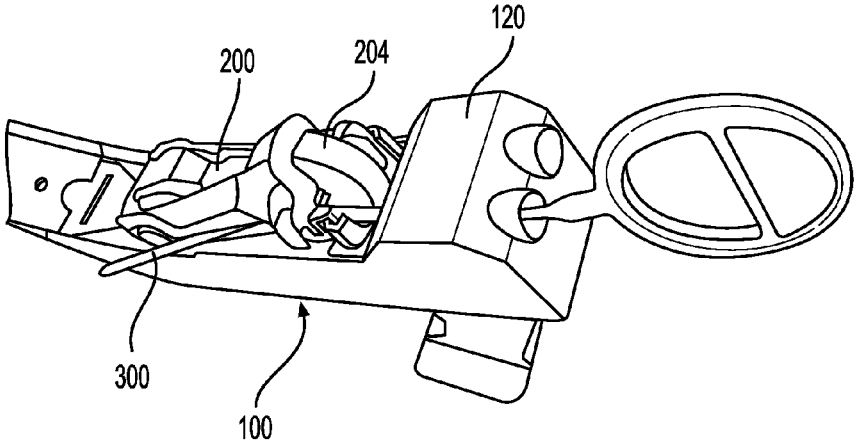
FIG. 12 is a top view of the launcher of FIG. 1 showing the toy vehicle positioned ready for launch.
Figure 13:
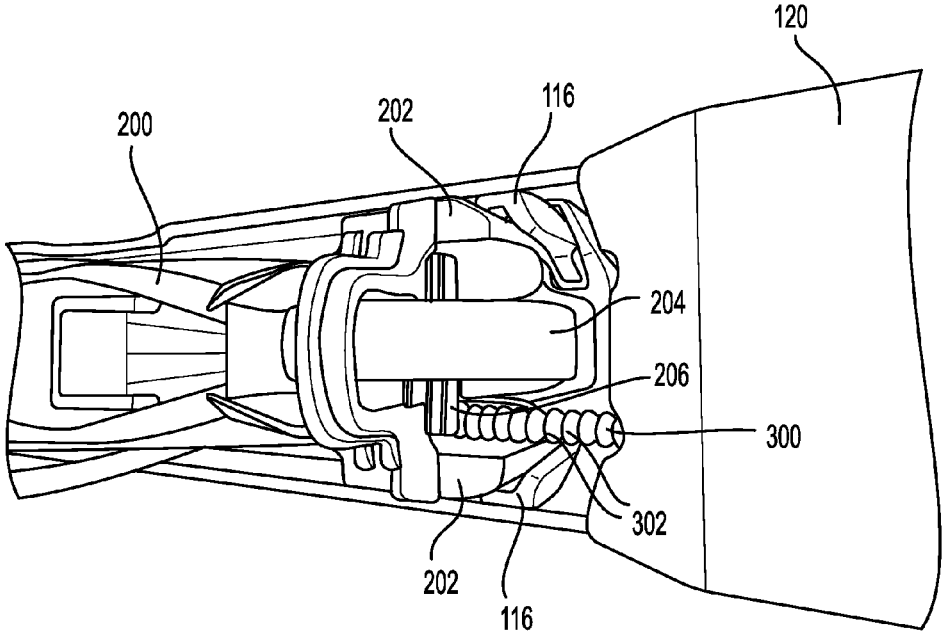
FIG. 13 is a rear view of the launcher and toy vehicle of FIG. 12.
Figure 14:
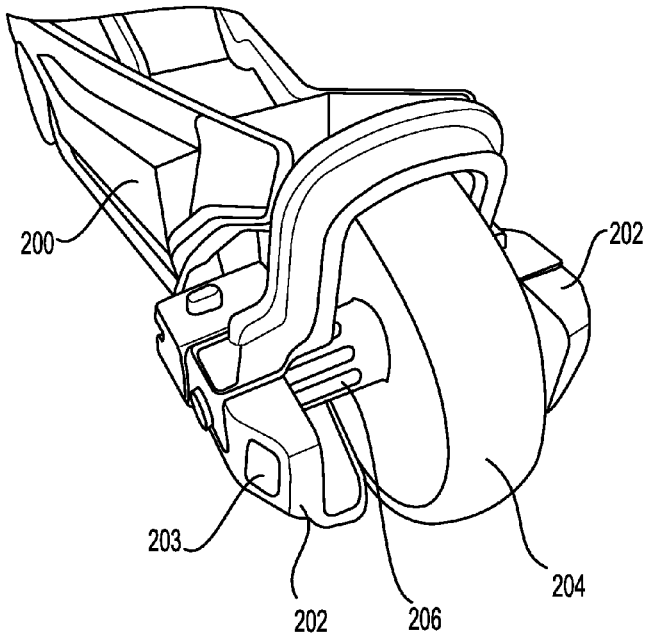
FIG. 14 is a close-up, rear perspective view of a toy vehicle for use with the launcher of FIGS. 1 and 2.

FIGS. 12 and 13 provide close-up views of toy vehicle 200 positioned on launcher 100 with a pull cord 300 inserted through housing block 120 of launcher 100 and engaging toy vehicle 200. Toy vehicle 200 includes drive wheel 204 affixed to axle 206 having teeth configured to engage the ribs 302 of pull cord 300. In FIGS. 12 and 13, moveable arms 116 are shown engaging engagement clips 202 to hold toy vehicle in place on carriage 110. FIG. 14 provides a close-up side view of engagement clips 202, drive wheel 204, and axle 206 on toy vehicle 200. As shown in FIG. 14, each engagement clip 202 has a notch 203 which receives an engaging surface on one of moveable arms 116 of carriage 110 to hold toy vehicle 200 in place.

Figure 15:
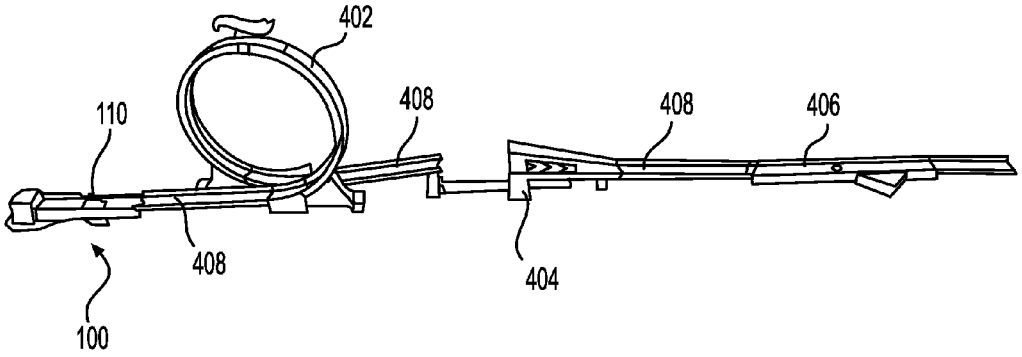
FIG. 15 is a side view of a toy track employing the launcher of FIGS. 1 and 2.
Figure 16:
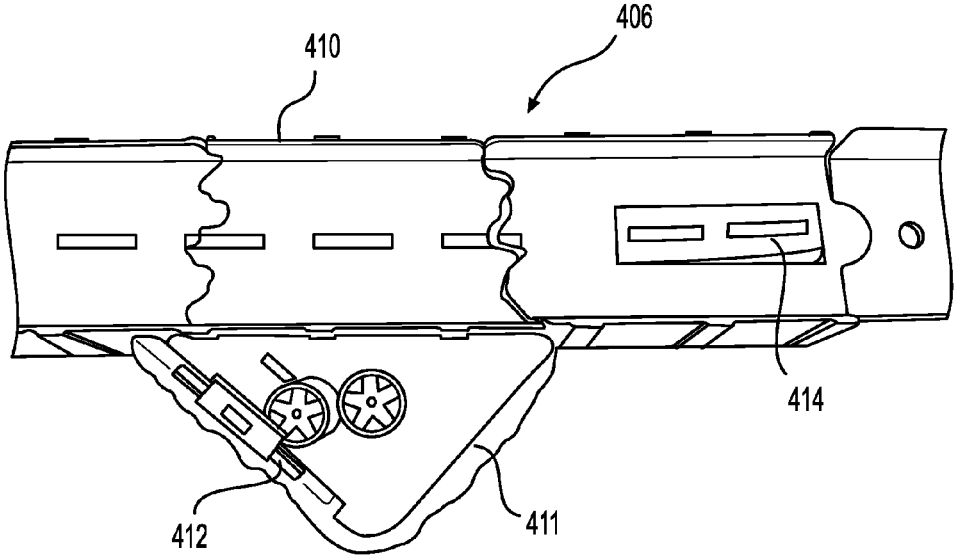
FIG. 16 is a top view of a stunt track segment for use with the toy track of FIG. 15.
Figure 17:
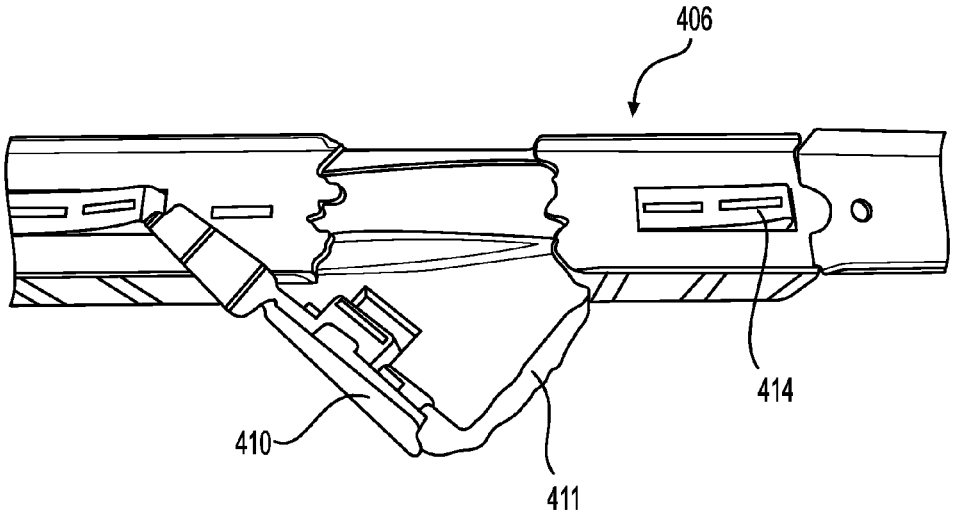
FIG. 17 is a top view of the stunt track segment of FIG. 16 after activation of a stunt feature.

FIG. 15 shows an exemplary toy track that may be used in conjunction with launcher 100. More particularly, and by way of non-limiting example, a toy track may be attached to launcher 100 that includes multiple stunt features, such as a loop section 402, an open track and receiving ramp section 404, and a feature section 406, each of which stunt features is connected through extruded plastic track sections 408. As shown in FIGS. 16 and 17, section 406 may include, for example, a spring loaded track segment 410 that may be pivotably attached to a base section 411 at pivot connection 412. A trigger 414 may be provided that, when engaged by a toy vehicle traveling through section 408 from left to right in FIGS. 16 and 17, releases a retainer or latch mechanism within base section 411 to allow a spring member to pivot spring loaded track segment 410 upward, thus revealing an alternative surface that creates the appearance that the toy vehicle is "ripping" or "tearing up" the track. Optionally, multiple triggers 414 and pivoting spring loaded track segments 410 may be provided that a toy vehicle will traverse and trigger in sequence as it progresses through the toy track.

Of course, those skilled in the art will recognize that any combination of the above track features and alternatives therefor may be used with launcher 100 without departing from the spirit and scope of the instant invention.

Figure 18:
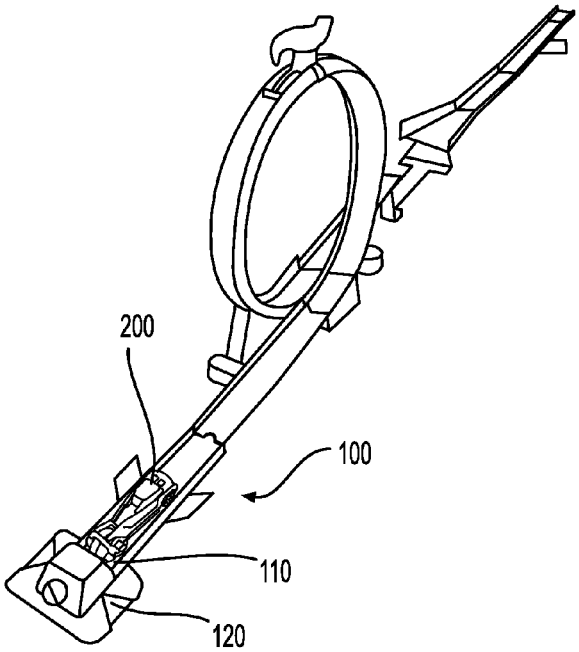
FIG. 18 is a perspective view of the launcher of FIGS. 1 and 2 with a pull cord inserted through the launcher housing and toy vehicle.
Figure 19:
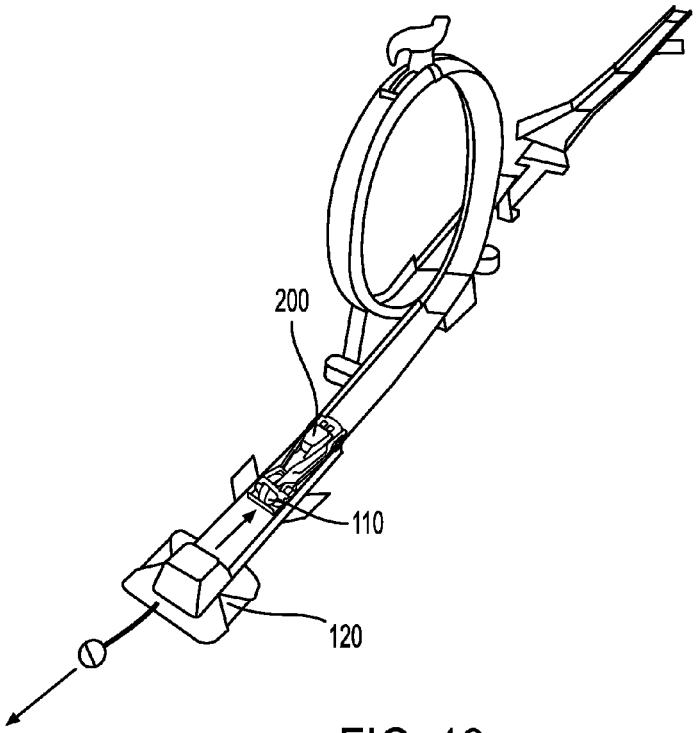
FIG. 19 is a perspective view of the launcher of FIG. 18 showing the pull cord being withdrawn from the launcher and the carriage beginning to move away from the armed, ready position.

In use, and with respect to FIGS. 18 and 19, a user first positions carriage 110 so that the back of carriage 110 is immediately adjacent housing block 120, thus assuming the armed, ready position. Next, as shown in FIG. 18, the user positions a toy vehicle 200 on carriage 110, and inserts pull cord 300 through housing block 120 and into toy vehicle 200 so as to engage axle 206 of toy vehicle 200. Next, as shown in FIG. 19, the user quickly withdraws pull cord 300 from housing block 120. As pull cord 300 is withdrawn, the circular ribs 302 of pull cord 300 engage axle 206 so as to rotate drive wheel 204. Likewise, as pull cord 300 is fully withdrawn from housing block 120, carriage capture and release assembly 124 (as discussed in detail above) releases carriage 110, allowing elastic member 140 to propel carriage 110 forward to launch toy vehicle 200.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A toy vehicle launcher, comprising:

a housing including a release assembly;

a ramp section coupled to the housing, the ramp section defining a slot therein;

a slidable carriage that is movable along the slot between a loaded position and a launched position, the slidable carriage being retained in its loaded position and biased toward its launched position by a biasing member, the slidable carriage being engageable with the release assembly, wherein the slidable carriage includes an arm movably coupled thereto, the arm being engageable with a toy vehicle positioned on the launcher; and a pull cord engageable with the housing, the pull cord being engageable with the release assembly and a toy vehicle coupled to the slidable carriage, the slidable carriage being released from its loaded position when the pull cord is retracted from the release assembly and traveling along the slot in the ramp section.

2. The toy vehicle launcher of claim 1, wherein the arm moves relative to the slidable carriage as the slidable carriage moves along the ramp section.

3. The toy vehicle launcher of claim 1, wherein the ramp section includes a cam surface and the movable arm engages the cam surface as the carriage moves on the ramp section.

4. The toy vehicle launcher of claim 3, wherein the arm has an outer position and an inward position relative to the carriage, and the arm moves from its outer position to its inward position as the arm engages the cam surface.

5. The toy vehicle launcher of claim 1, wherein the arm moves between an outer position and an inward position relative to the carriage, the arm being engageable with the toy vehicle in its outer position.

6. A toy vehicle and launcher assembly, comprising:

a toy vehicle having a wheel and an axle coupled to the wheel, the axle having a set of teeth; and a launcher, comprising:

a housing;

a ramp section coupled to the housing;

a carriage coupled to the ramp section and movable relative to the housing, the toy vehicle being engageable with the carriage, the carriage being positionable in a launching position and in a loaded position, wherein the carriage includes an arm movably coupled thereto, the arm being engageable with the toy vehicle engaged with the carriage; and a pull cord engageable with the housing, the carriage, and the toy vehicle, wherein removal of the pull cord from the housing, the carriage, and the toy vehicle results in the carriage moving along the ramp section and the toy vehicle disengaging from the carriage.

7. The toy vehicle and launcher assembly of claim 6, wherein the arm comprises a pair of arms, and each of the pair of arms is movable between an outer position and an inward position relative to the carriage.

8. The toy vehicle and launcher assembly of claim 7, wherein the pair of arms move from their outer positions to their inward positions as the carriage moves from its launching position to its loaded position.

9. The toy vehicle and launcher assembly of claim 8, wherein the toy vehicle includes a pair of notches and each of the pair of arms is engageable with one of the notches.

10. The toy vehicle and launcher assembly of claim 7, wherein the ramp section includes a pair of cam surfaces and each of the pair of arms engages one of the cam surfaces when the carriage slides along the ramp section.

11. The toy vehicle and launcher assembly of claim 10, wherein the engagement of the pair of arms with the cam surfaces causes the pair of arms to move from their outer positions to their inward positions.

12. The toy vehicle and launcher assembly of claim 11, wherein the pair of arms engage the toy vehicle when the pair of arms are in their inward positions and the pair of arms are spaced from the toy vehicle when the pair of arms are in their outer positions.

13. The toy vehicle and launcher assembly of claim 10, wherein the pair of arms engage the cam surfaces as the carriage moves from its launching position to its loaded position.

14. The toy vehicle and launcher assembly of claim 13, wherein the pair of arms move from their inward positions to their outer positions when the carriage moves from its loaded position to its launching position.

15. The toy vehicle and launcher assembly of claim 6, wherein the launcher includes a release assembly that is engaged by the pull cord, and the pull cord activates the release assembly when the pull cord is pulled from the toy vehicle, the carriage, and the housing.

16. The toy vehicle and launcher assembly of claim 15, wherein the release assembly is in the housing and retains the carriage in its loaded position.

17. The toy vehicle and launcher assembly of claim 6, wherein the pull cord extends through the housing, through the carriage, engages a release assembly in the carriage, and engages the teeth on the axle of the toy vehicle.

18. The toy vehicle and launcher assembly of claim 17, wherein the launcher includes a biasing member, and the pulling of the pull cord rotates the wheel of the toy vehicle, and releases the carriage so that the biasing member moves the carriage and the toy vehicle along the ramp section and the toy vehicle disengages from the carriage and travels down the ramp section.

19. A toy vehicle launcher, comprising:

a housing including a release assembly;

a ramp section coupled to the housing, the ramp section defining a slot therein;

a slidable carriage that is movable along the slot between a loaded position and a launched position, the slidable carriage being retained in its loaded position and biased toward its launched position by a biasing member, the slidable carriage being engageable with the release assembly, wherein the carriage includes a pair of arms that move between outer positions and inward positions relative to the carriage as the carriage moves along the ramp section; and a pull cord engageable with the housing, the pull cord being engageable with the release assembly and a toy vehicle coupled to the slidable carriage, the slidable carriage being released from its loaded position when the pull cord is retracted from the release assembly and traveling along the slot in the ramp section.

20. The toy vehicle launcher of claim 19, wherein the arms engage a toy vehicle positioned on the launcher when the arms are in their inward positions and the arms are spaced from the toy vehicle when the arms are in their outer positions.

* * * * *